US006739797B1

(12) United States Patent
Schneider

(10) Patent No.: US 6,739,797 B1
(45) Date of Patent: May 25, 2004

(54) INTERLOCKING EROSION CONTROL BLOCK WITH INTEGRAL MOLD

(76) Inventor: Thomas W. Schneider, 3400 Steven, Plano, TX (US) 75023

( * ) Notice: Subject to any disclaimer, the term of this patent is extended or adjusted under 35 U.S.C. 154(b) by 0 days.

(21) Appl. No.: 09/687,722

(22) Filed: Oct. 12, 2000

Related U.S. Application Data

(60) Provisional application No. 60/171,532, filed on Dec. 22, 1999.

(51) Int. Cl.[7] ..... E01C 5/00; E02B 3/12

(52) U.S. Cl. ..... 404/35; 404/37; 404/40; 404/41; 404/52; 404/73; 405/16; 405/20; 52/602

(58) Field of Search ..... 404/34, 35, 37, 404/40, 41, 47, 52, 73; 405/16, 20, 19; 52/589.1, 602

(56) References Cited

U.S. PATENT DOCUMENTS

| | | | | |
|---|---|---|---|---|
| 1,164,707 A | | 12/1915 | Edinger | |
| 2,308,677 A | * | 1/1943 | Dailey | 404/60 |
| 3,386,252 A | | 6/1968 | Nelson | |
| 3,822,499 A | * | 7/1974 | de Vos | 446/121 |
| 3,903,702 A | * | 9/1975 | Appleton | 404/41 |
| 4,142,821 A | | 3/1979 | Doring | 405/258 |
| 4,152,875 A | | 5/1979 | Soland | 52/227 |
| 4,370,075 A | * | 1/1983 | Scales | 404/41 |
| 4,372,705 A | * | 2/1983 | Atkinson | 404/40 |
| 4,474,504 A | | 10/1984 | Whitman et al. | 405/16 |
| 4,502,815 A | | 3/1985 | Scales et al. | 405/17 |
| 4,592,675 A | | 6/1986 | Scales et al. | 405/19 |
| 4,621,942 A | | 11/1986 | Hill | 404/41 |
| 4,671,699 A | | 6/1987 | Roach | 404/41 |
| 4,683,156 A | | 7/1987 | Waters | 428/52 |
| 4,693,632 A | | 9/1987 | Ingersoll | 405/18 |
| 4,702,048 A | * | 10/1987 | Millman | 52/169.5 |
| 4,719,738 A | * | 1/1988 | Lee | 52/607 |
| 4,726,708 A | | 2/1988 | Papetti | 405/19 |
| 4,875,803 A | * | 10/1989 | Scales | 405/16 |
| 4,889,446 A | | 12/1989 | Holmberg | 405/19 |
| 4,963,054 A | * | 10/1990 | Hayashi | 404/34 |
| 5,024,560 A | | 6/1991 | Reilly | 405/303 |
| 5,035,532 A | | 7/1991 | Gargollo | 404/41 |
| 5,040,572 A | | 8/1991 | Lindberg | 139/410 |
| 5,108,222 A | | 4/1992 | Jansson et al. | 405/20 |
| 5,129,756 A | | 7/1992 | Wheeler | 405/23 |
| 5,160,215 A | * | 11/1992 | Jensen | 404/35 |
| 5,167,843 A | | 12/1992 | Guillory | 249/83 |
| 5,250,340 A | | 10/1993 | Bohnhoff | 428/99 |
| 5,256,007 A | | 10/1993 | Allen | 405/258 |
| 5,288,165 A | | 2/1994 | Douwes Dekker | 404/35 |

(List continued on next page.)

FOREIGN PATENT DOCUMENTS

| | | | |
|---|---|---|---|
| GB | 891522 | 3/1962 | 20/107 |
| JP | 59-224710 | 12/1984 | E02B/3/14 |
| JP | 59-224711 | 12/1984 | E02B/3/14 |

OTHER PUBLICATIONS

"Building Blocks, Army Style", Paul Campbell, *Erosion Control*, Forester Communications, Inc. 1999–2000.

Dura~Mat™ "Protection Forever", brochure, Retaining Wall Systems, Ontario, 1991.

*Primary Examiner*—Gary S. Hartmann
(74) *Attorney, Agent, or Firm*—Roger N. Chauza, Esq.; Chauza & Handley, LLP

(57) ABSTRACT

A block (11) formed with a mold (10) integral thereto. The mold (10) is constructed as a mold top half (12) and a mold bottom half (14) and filled in situ with cement (16). The mold halves (12,14) are constructed with respective socket and channel structures (24, 20) to capture an enlarged end (38) of a connector (34) for interlocking one block to a neighboring block. The resulting block (11) constitutes a one-piece block that can be formed at the installation site using the two-part mold (10). The interlocked blocks are prevented from removal when moved in either lateral direction, or in the vertical direction.

30 Claims, 10 Drawing Sheets

U.S. PATENT DOCUMENTS

| | | | | |
|---|---|---|---|---|
| 5,429,451 | A | | 7/1995 | Pettee, Jr. ..... 405/20 |
| 5,556,228 | A | | 9/1996 | Smith ..... 405/16 |
| 5,615,971 | A | | 4/1997 | Boeve ..... 404/37 |
| 5,632,571 | A | | 5/1997 | Mattox ..... 405/19 |
| 5,702,208 | A | | 12/1997 | Hilfiker et al. ..... 405/258 |
| 5,713,155 | A | | 2/1998 | Prestele ..... 47/33 |
| D392,750 | S | | 3/1998 | Scales ..... D25/113 |
| 5,775,837 | A | | 7/1998 | Schneider ..... 405/17 |
| 5,779,391 | A | * | 7/1998 | Knight ..... 405/20 |
| 5,937,602 | A | * | 8/1999 | Jalbert ..... 52/318 |
| 6,071,041 | A | | 6/2000 | Knight ..... 405/16 |
| 6,276,870 | B1 | * | 8/2001 | Smith ..... 405/16 |

* cited by examiner

INTERLOCKING EROSION CONTROL BLOCK WITH INTEGRAL MOLD

CROSS REFERENCE TO RELATED APPLICATIONS

This patent application claims the benefit of pending provisional patent application entitled "THREE DIMENSIONAL LOCKING CONCRETE REVETMENT BLOCK", Ser. No. 60/171,532, filed Dec. 22, 1999, the entire disclosure of which is incorporated herein by reference.

TECHNICAL FIELD OF THE INVENTION

The present invention relates in general to blocks including pavers, erosion control blocks, patio blocks, and other related types of blocks, and more particularly to interlocking blocks that are formed with a mold at the installation site.

BACKGROUND OF THE INVENTION

The prior art is replete with the disclosure of many blocks which are interconnected together to from a mat or matrix of blocks to prevent soil erosion as a result of water, wind, traffic, etc. Various blocks can be interconnected by ropes, cables, wires, geofabrics, and many other types of mechanisms to prevent the blocks or groups of blocks from substantial lateral movement. A recent trend is to fabricate blocks that are interlocked by the use of an arm extension of one block interlocked in a socket opening of an adjacent block. This type of block prevents substantial horizontal movement without the necessity of cables or ropes threaded therethrough, or direct attachment to a geofabric. Such type of blocks are disclosed in U.S. Pat. No. 5,035,532 by Gargollo; U.S. Pat. No. 5,429,451 by Pettee, Jr.; U.S. Pat. No. 5,556,228 by Smith and U.S. Pat. No. 5,775,837 by Schneider. While these types of erosion control blocks function very well in preventing erosion of the soil at the installation site, the fabrication and installation of the same is very labor intensive.

Many of the foregoing interlocking blocks, as well as non-interlocking blocks, are fabricated by block plant equipment. Such type of equipment constitutes a large and expensive machine which utilizes a reusable mold to stamp the blocks from "green" concrete. The blocks must then be manually stacked on a pallet and moved to a location for allowing the concrete to set and cure. Then, the skid of blocks must be loaded on a truck or rail system and transported to the installation site. At the installation site, the skid of blocks must be unloaded by motorized equipment and then manually installed by workmen who must lift each block which can weigh up to 80 pounds, and lower it in an interlocking relationship with other installed locks. In other situations which may involve both interlocking and noninterlocking blocks, ropes or cables can be manually threaded through the installed blocks to provide additional containment. It is a common practice to utilize ropes threaded through interlock blocks to provide a mat of blocks which can be lifted by a crane and lowered at the installation site. Blocks fabricated for use with cable conduits therethrough are more expensive to fabricate as a tubular member must be set within the concrete block to form the channel.

Another technique for fabricating or casting a block is by the use of stamped dry concrete mix. This process is designed to be used for an off-site manufacturing plant. The blocks are formed by a machine which inserts loose dry mix concrete into a mold and then stamps and vibrates the dry mix until the block is formed. The blocks are then removed and allowed to cure. After the curing process, the blocks are either readied for shipment, or are then placed onto a lacing table and made into a matrix section at the plant. One of the disadvantages to this process is that the blocks cannot be made on site, and the process requires that the blocks be shipped to the site. The cost of the block is then greatly affected by trucking/shipping costs, and the proximity of the block plant to the project location.

If the project is located in an area that would make it unprofitable due to shipping expense, a local plant must be found. If such a plant is located near the project, it is necessary then to pay another manufacturer to produce the block, which is necessarily more costly than producing it at one's own plant. Another consideration is that the nearby manufacturer may have a machine which is incompatible with the mold of the block to be made, and the cost of a new mold to be used for the particular machine increases the cost per block made. These molds, depending on the machine manufacturer and the shape of block mold, may cost in the area of $30,000 to $40,000. In addition, the useful life of the mold itself must be considered since the output expectancy of each mold is limited to 600,000–800,000 square feet of block coverage.

Another method utilized in fabricating blocks is a wet cast technique. This method is used to produce blocks at the installation site, or near the project location. The manufacturing process requires each block to be poured by hand utilizing many individual molds. The molds are then vibrated to fill the voids caused by pouring inconsistencies. The wet cast concrete is then allowed to cure for a day or two, depending on the concrete mix. The blocks are then removed from the molds and placed on a pallet to complete the curing process. Once the blocks have cured, they are then individually installed at the site by hand.

If the blocks are to be made into a matrix section using cables or ropes, the forms must incorporate the use of a tube or pipe in the manufacture of the block so that a cable can be used to lace the blocks together, forming a mattress or matrix section.

The wet cast method is very labor intensive, therefore, it is cost-effective only when used on small projects. The production output is directly linked to the number of molds on one location and the length of time it takes the blocks to cure so that the molds can then be reused. If enough molds are available to produce 1,000 square feet of blocks, then 1,000 square feet can be produced every day or two, depending on the curing period. Since most blocks cover less than 2 square feet of area, it would necessitate the use of approximately 600 molds to produce 1,000 square feet per day. The approximate cost per mold is presently about $35.00, which would require a capital outlay of nearly $21,000 in order to produce the required 1,000 square feet per day. The cost per square foot of this method makes large projects cost prohibitive.

Where it is desired to prevent erosion of large waterways, channels and the like, thousands of erosion control blocks may be necessary. It can be appreciated that the cost per square foot of installed erosion control blocks is critical, it being realized that if more equipment or materials and labor is necessary, installation costs increase. Where the bidding of such type of projects is involved, it is highly advantageous to be able to provide a turn key installation at a low material and labor cost.

From the foregoing, it can be seen that a need exists for a new type of block that is both constructed and installed at the site where erosion is to be controlled. Another need exists for a new type of interlocking block that is of a one-piece design, but where three dimensional interlocking capabilities is achieved. Another need exists for a cost effective block where the mold is integral with the block itself.

SUMMARY OF THE INVENTION

In accordance with the principles and concepts of the invention, there is disclosed an interlocking erosion control block that substantially reduces the shortcomings and disadvantages of the prior art blocks. In accordance with one aspect of the invention, there is disclosed a block that utilizes a mold for forming the interlocked block, where the mold can be utilized at the installation site for fabricating the block, and where the mold thereafter remains integral with the block. In accordance with another aspect of the invention, the block is fabricated as a one-piece block with openings formed from a top surface thereof to the bottom surface by the utilization of opening members forming a part of the mold. In accordance with another aspect of the invention, the one-piece block is made interlocking by the use of a socket cavity and channel arrangement formed within the block for capturing therein the enlarged end of a connector member. The connector member is constructed of a high impact plastic having an elongate midsection with enlarged ends. The other end of the connector member is captured in a similar socket cavity and channel arrangement of a neighboring block.

The installation of the erosion control block according to one feature of the invention involves the utilization of a two-part mold, namely a mold top half and a mold bottom half which, when snap fit or otherwise locked together, provide a composite mold for pouring therein concrete, or the like. The mold halves are identical in construction. The two-part mold has molded integral therewith the opening members for forming the holes through the block, as well as the socket cavities and channel structures to provide the interlocking capabilities. In accordance with another feature, opening members can be formed as part of the mold to form the cavities of interlocking blocks of the type in which the cavities are formed in the side edge of the block, from the top surface to the bottom surface thereof.

In the installation and formation of the block, the mold bottom halves are first laid out on the ground surface that is to be protected from erosion. Then, the connectors are inserted in the mold bottom halves, with the enlarged end of each connector laid in the socket cavity and channel structure portions of the respective mold bottom halves. Next, the mold top halves are snap locked onto the mold bottom halves, thereby capturing the connector ends within the socket cavities and channel structures of the neighboring blocks. A foam or other suitable material is placed around each composite mold in the spaces between the neighboring blocks to prevent the concrete from filling the interblock spaces. A foam filler is also placed inside each block hole, it if is desired to provide vegetation growth holes in the blocks. Lastly, concrete or another heavy material is disposed in each composite mold and allowed to set. The foam filler is then removed, thereby leaving a complete mat or matrix of interlocked blocks covering the ground to be protected. Substantial costs in labor and fabrication of the blocks is thus realized.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
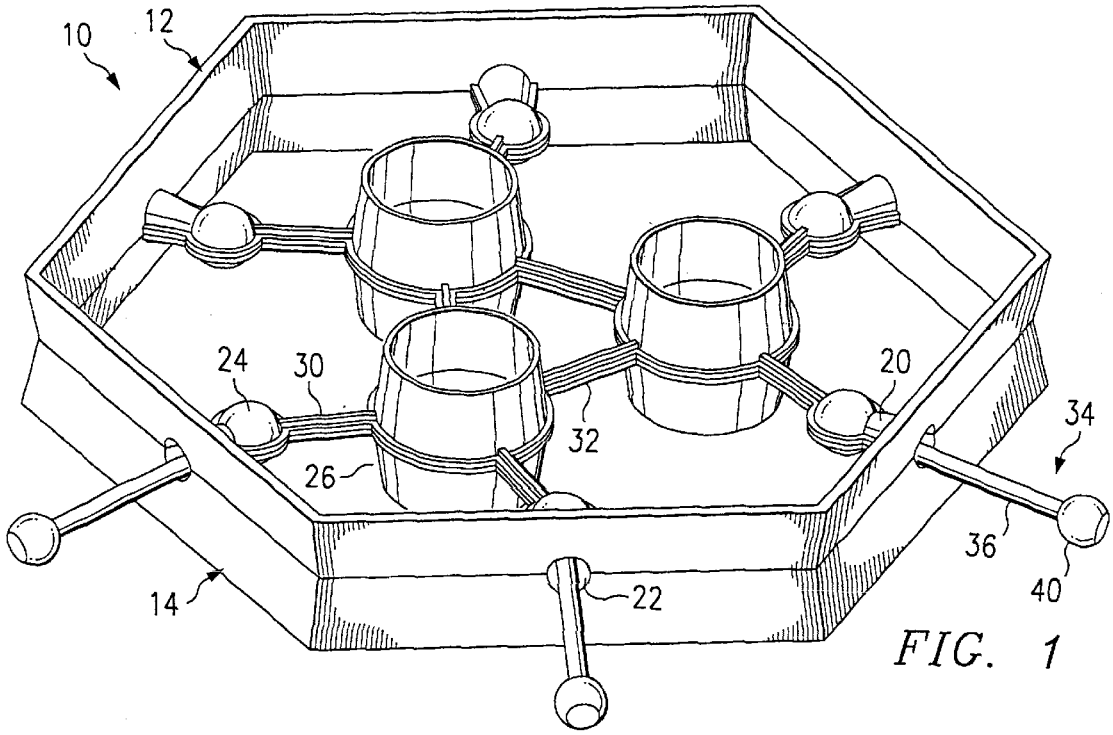
FIG. 1 is an isometric view of the two-part mold snapped together to form a composite mold, with the connectors captured within the composite mold.
Figure 2:
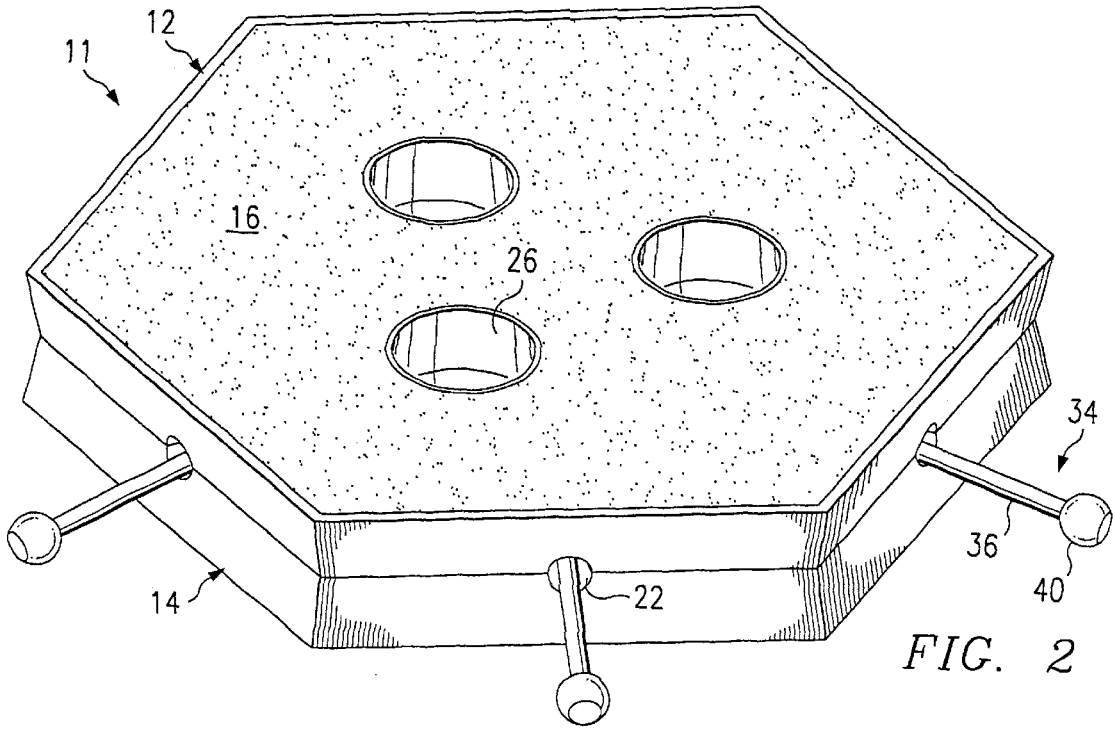
FIG. 2 is an isometric view of the mold of FIG. 1, but filled with a concrete material.

Referring now to FIGS. 1–4, there is illustrated a two-part mold 10 having a mold top half 12 and a mold bottom half 14 snap-fit together. FIG. 2 illustrates the composite mold 10 filled with concrete 16. Because of the nature of the mold halves 12 and 14, as will be described in more detail below, the composite mold 10 remains integral with the concrete 16 to form a block 11 to protect a ground surface, or other surface from erosion.

Figure 3:
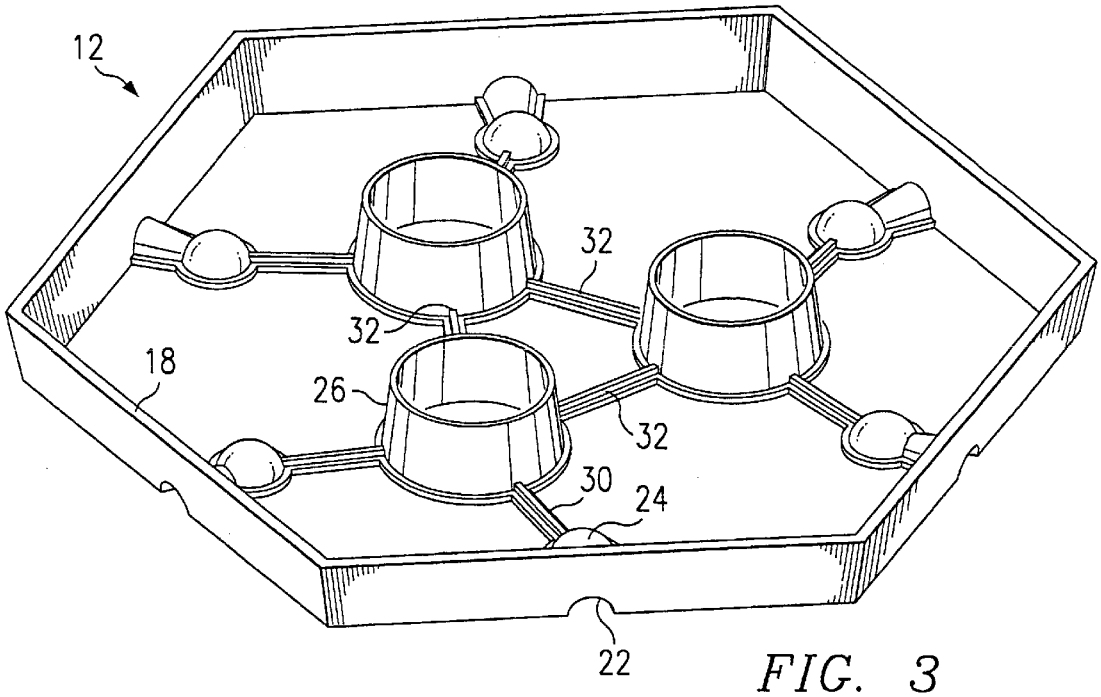
FIG. 3 is an isometric view of the mold top half of FIG. 1.
Figure 4:
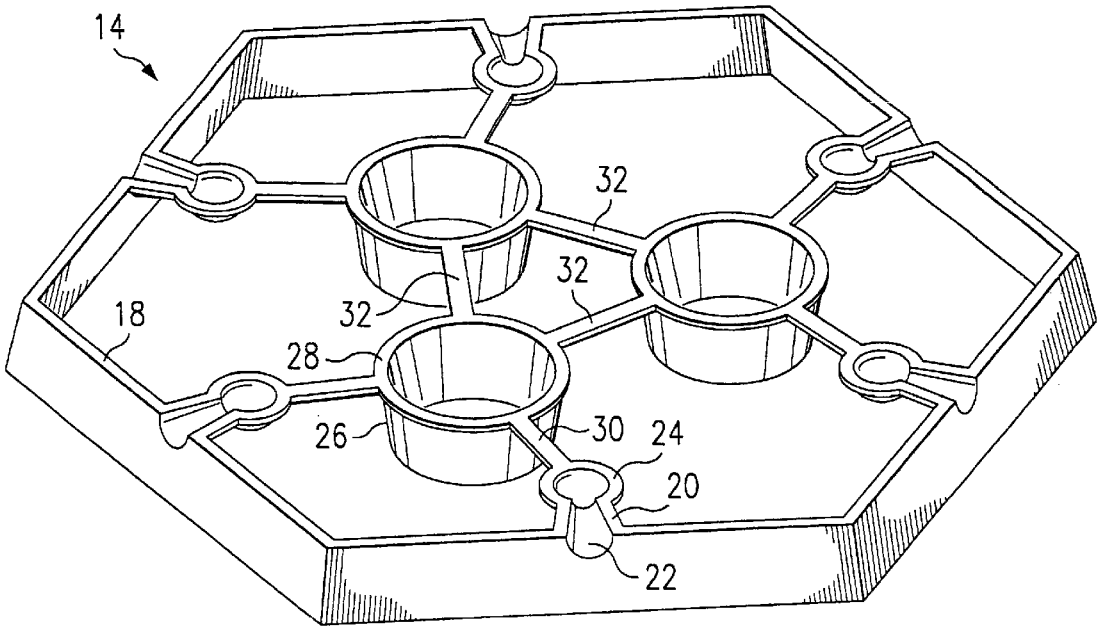
FIG. 4 is an isometric view of the mold bottom half of FIG. 1.

The mold top half 12 is shown in more detail in FIG. 3 and the mold bottom half 14 is shown in more detail in FIG. 4. Although the mold top half 12 and mold bottom half 14 are snap-fit together, FIGS. 3 and 4 do not illustrate the arrangement for snap-fitting the mold halves together. In accordance with an important feature of the invention, the mold top half 12 is constructed substantially identical to the mold bottom half 14, thereby facilitating fabrication of the mold, reducing costs of the molded frame, and making it easy to install as a workman does not have to differentiate between different mold parts. With specific reference to FIG. 4, there is illustrated the mold bottom half 14. The mold bottom half 14 is preferably constructed of a synthetic material, such as plastic, and formed by conventional injection molding techniques. The mold bottom half 14 includes a circumferential or peripheral edge band 18, formed in a hexagonal shape. While the hexagonal shape is believed to provide certain advantages when used in constructing an erosion control block, many other regular and irregular shapes, such as circles, ovals, squares, rectangles, octagonals, pentagons, etc. can be utilized. In order to facilitate ease of removal from the injection mold, the edge band 18 is formed with a slight draft, such as 5°, as measured from a vertical reference. The draft angle can be seen in FIGS. 1 and 2, when the mold halves are placed together.

With reference again to FIG. 4, molded integral with the edge band 18 are a number of semi-conical shaped channel structures 20 which open to an opening 22 at the face of the edge band 18. A semi-spherical socket cavity 24 is formed at the smaller end of the conical-shaped channel structure 20. As will be described in more detail below, the enlarged end of a connector 34 is fitable in the socket structure 24, and an elongate midsection 36 of the connector 34 extends through the opening 22 defined by the conical-shaped structure 20. While a socket cavity structure 24 and a corresponding conical-shaped channel structure 20 are shown as formed in the center of each side of the hexagon-shaped band 18, those skilled in the art may prefer to form fewer or more than six such structures for a hexagonal-shaped band 18.

One or more cylindrical-shaped opening members, one shown as reference numeral 26, are formed integral with the mold bottom half 14. The cylindrical-shaped member 26 defines a portion of a hole that can be formed from the top surface of the block to the bottom surface thereof. The cylindrical-shaped member 26 is formed with the same draft angle as the edge band 18. In addition, an annular flange 28 is formed around one annular edge of the cylinder member 26 to provide rigidity thereto. Each socket cavity structure 24 is connected by a respective web 30 to a cylindrical-shaped member 26. The embodiment shown in FIG. 4 has an edge band 18 formed in a hexagonal shape, three cylindrical members 26, and two socket structures 24 connected by respective webs 30 to a same cylindrical-shaped member 26. There is an additional web 32 that connects each cylindrical-shaped member 26 together to provide stability thereto. The internal webs also provide a conduit or mechanism in the injection molding process to distribute the melted plastic to form the mold halves. Because of the various web structures internal to the edge band 18, the mold bottom half 14 remains integral with the block when filled with concrete. The interconnected members 30 and 32 internal to the edge band 18 also function to provide support for the edge band 18 when filled with wet concrete, so that the hexagonal shape is maintained. The bottom side of the mold half 14 depicted in FIG. 4 is shown in detail in FIG. 3, it being realized that the same mold is used both for the mold top half 12 and the mold bottom half 14. With this construction, an installer at the site need not differentiate between mold top halves or mold bottom halves, but rather may select any mold half and use it as either the mold top or bottom half.

As will be described below, the mold halves can also incorporate opening members to form open interlocking cavities that extend between the top and bottom surfaces of the block. Other shapes and sizes of opening members can be utilized at different locations to form openings between the top and bottom surface of a block.

Figure 5:
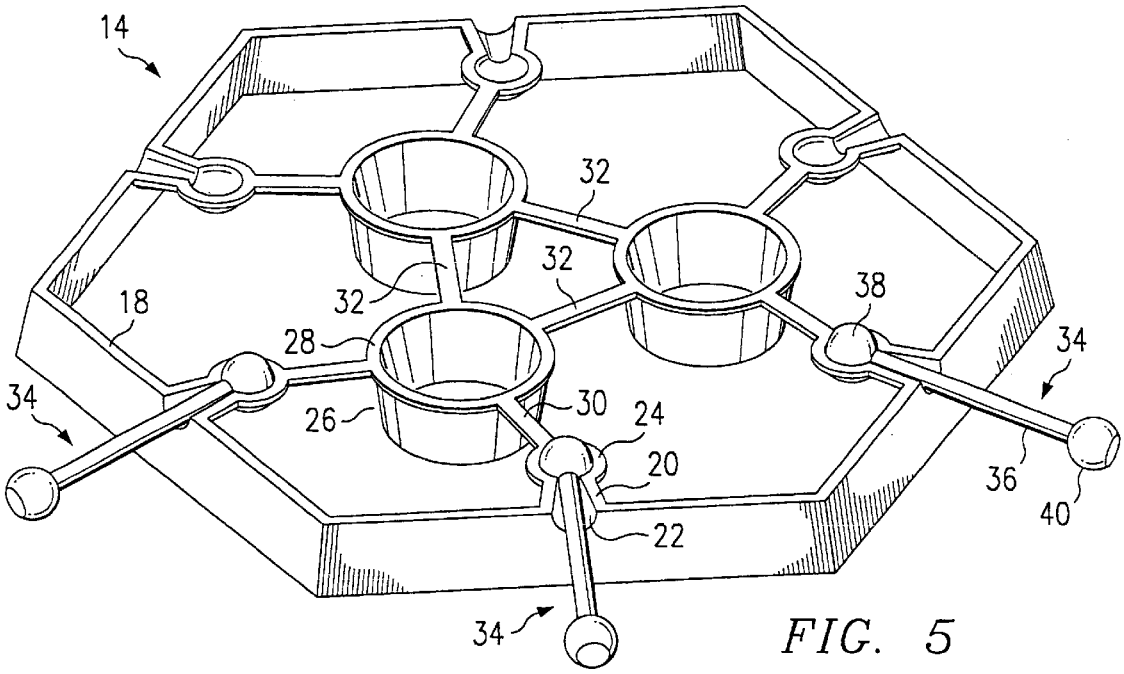
FIG. 5 is an isometric view of the mold bottom half with three connectors laid in respective socket cavity halves.

FIG. 5 illustrates the mold bottom half 14 with connectors 34 inserted into the respective socket cavities 24 and associated channel structures 20. Each connector 34 includes an elongate midsection 36 with an enlarged end 38 formed at one end, and a similar enlarged end 40 formed at the other end. The enlarged ends 38 and 40 are preferably spherical-shaped, and the midsection 36 is preferably rod-shaped and circular in cross-section. The connector 34 is preferably made of a high impact type of material, such as nylon or polypropylene. By utilizing a strong plastic or synthetic connector 34, the interconnection is in many instances stronger than the block itself For a greater degree of strength, the connectors can be reinforced, such as by using a metal rod around which the plastic midsection 36 is molded. The length of the midsection 36 of the connector 34 determines the spacing between the blocks 11. As will be discussed in more detail below, the connectors 34 are initially formed integral with the mold halves and thereafter removed at the installation site.

Figure 6:
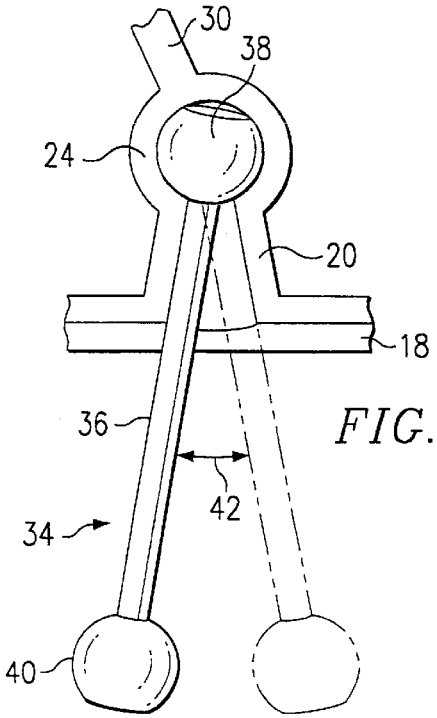
FIG. 6 is a partial isometric view of a portion of the mold bottom half, showing the extent of lateral movement of connector member.

FIG. 6 illustrates a partial view of the edge band 18, with the socket structure 24 and channel structure 20 formed integral thereto. The advantage of the conical-shaped channel structure 20 is that when the connector 34 is captured in the top and bottom socket-cavity, it is allowed to rotate in an extreme circular position so as to define a conical-shaped envelope of rotation. The conical-shaped channel 20 is formed such that the maximum angular displacement is about 25°, as shown by arrow 42. Angular displacements anywhere in the range between about 5° to 35° can provide sufficient block articulation, depending on the contour of the terrain upon which the blocks are installed. As an alternative to the use of a conical-shaped channel structure 20, a cylindrical-shaped channel structure (not shown) can be employed. If the cylindrical-shaped channel structure is axially short, and of a sufficiently large diameter, a large angular envelope of connector displacement is afforded. As yet another alternative, a pyramid-shaped channel structure can be utilized to provide a wide degree of flexibility between blocks.

With reference back to FIG. 5, it can be appreciated that when one end 38 of the connector 34 is disposed within the socket structure 24 and corresponding channel structure 20, and when another mold half is laid thereover and locked, the connector 34 becomes captured within the socket cavities of the two mold halves. However, because the socket structure 24 and channel structure 20 shield the connector end 38 from the cement or other heavy material, the connector end 38 is free to rotate within the mold half structures. In accordance with an important feature of the invention, the connector 34 and the corresponding socket and channel structures of the mold halves allow interconnected blocks to articulate with multiple degrees of freedom. This is in sharp contrast with prior art interlocked blocks, where such blocks can be removed from each other vertically, unless cabled or otherwise constrained together. The present one-piece block, however, can be interlocked with other blocks and rotated sideways, or up and down, or any other direction without being inadvertently removed from the interlocked condition. Importantly, each block is interlocked together so as to provide two locations of articulation between two neighboring blocks. As a result, no cables, ropes or other attached geofabrics are necessary to maintain the interlocked relationship between neighboring blocks.

Figure 7:
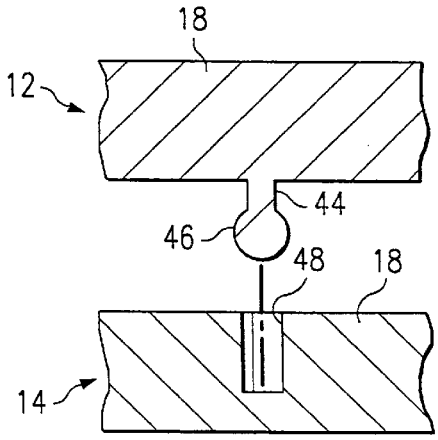
FIG. 7 is a partial cross-sectional view of the mold top and bottom halves, showing the manner in which they are snap fit together.
Figure 8:
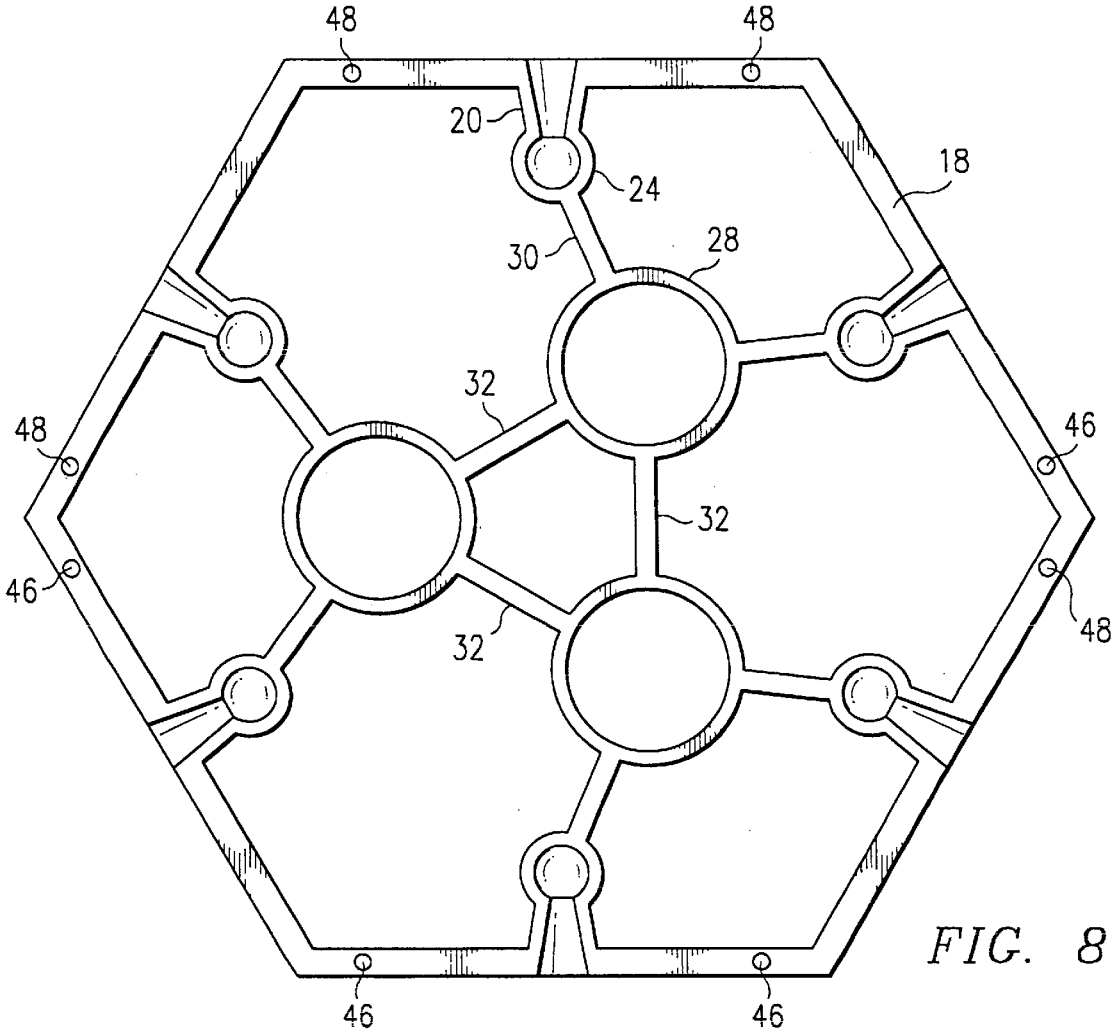
FIG. 8 is a top view of a mold bottom half, showing the circumferential edge band and the locations therein of the male and female snap fit members.

FIGS. 7 and 8 are respective side and top views that illustrate the manner in which the mold top half 12 and the mold bottom half 14 are snap-locked together. The snap-lock mechanism constitutes a small extension 44 formed on the edge of the edge band 18. The extension 44 includes an enlarged end 46. The enlarged end 46 is a spherical or other suitable shape for providing a press-fit into a corresponding cylindrical receptacle 48 formed in the edge of the other mold half. Various other shapes can be utilized for snap-locking the mold halves together. Other structures can be utilized for locking the mold halves together, such as screws, wires, straps, latches, pins, etc.

FIG. 8 illustrates the location of the enlarged ends 46 as well as the receptacles 48. Again, since the mold top half 12 and the mold bottom half 14 are identically constructed, the snap-lock structures must be arranged so as to match and lock the halves together. Moreover, the mold halves must be locked together such that the top and bottom cylindrical members 26 are aligned along a common vertical axis. To that end, the snap lock male and female members are arranged on each mold half such that the mold halves can be locked together. Once the connectors 34 are inserted into the corresponding socket structures 24 of the mold bottom half 14, as shown in FIG. 5, the mold top half can be lowered thereon and snap-fit to the mold bottom half 14. With this arrangement, the enlarged end 38 of each connector 34 is captured within the mold halves, but yet is allowed to move in an angular manner.

Figure 9:
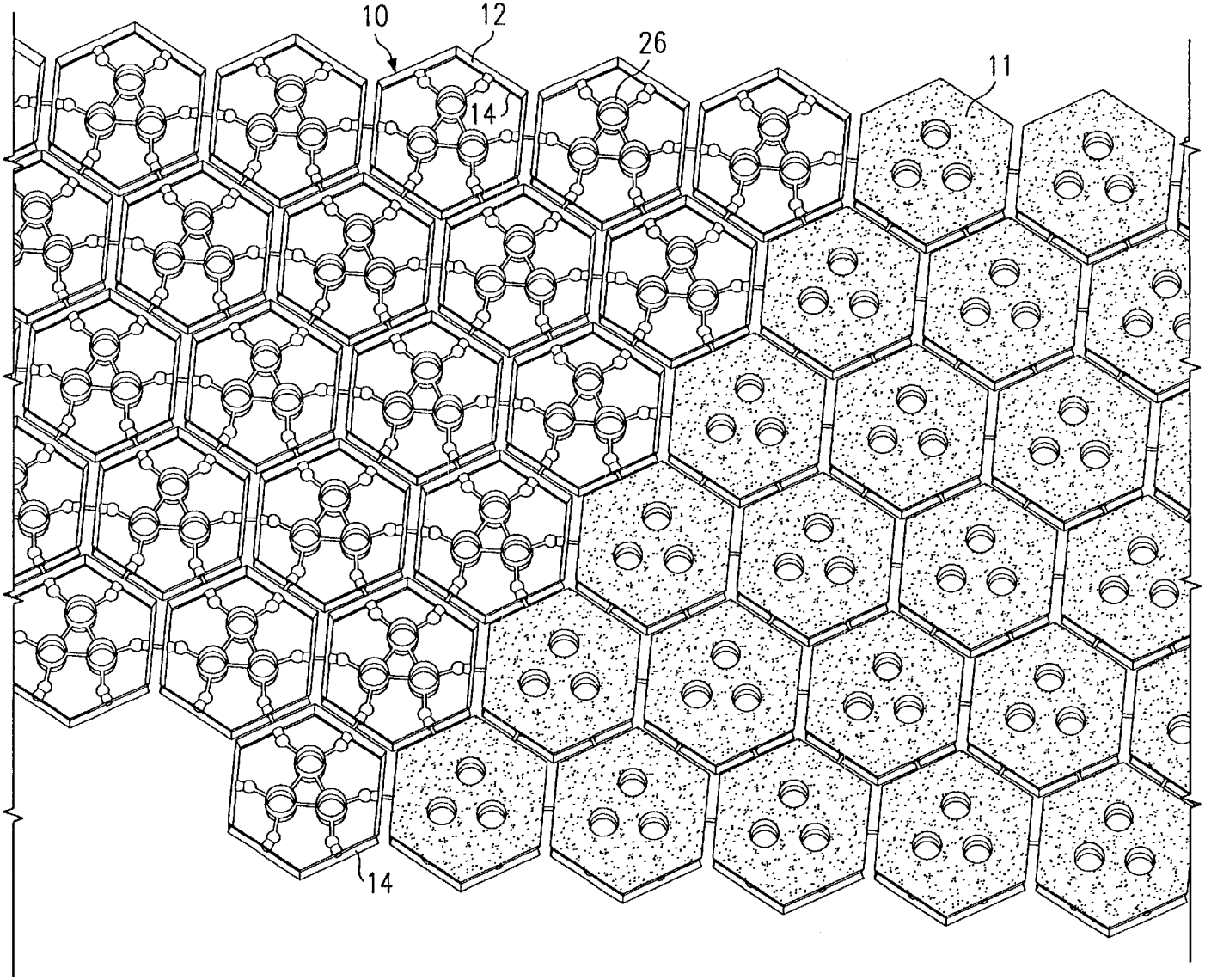
FIG. 9 is an isometric view of a portion of a block matrix with plural molds interlocked together, and with a portion of the composite molds filled with a concrete material.

FIG. 9 illustrates a matrix of interconnected erosion control blocks 11 constructed according to the principles and concepts of the present invention. A number of molds 10 are shown fully interconnected on the left side of the drawing, and a number of complete blocks 11 are shown interconnected on the right side of the drawing. While not shown, a filler, such as a foam-type material, is pressed into the spaces between the composite molds 10, as well as in the openings in the molds 10 to prevent concrete from filling such spaces. Concrete provided at the installation site by trucks and a pour-type boom can be poured into the molds 10, leveled and then allowed to set for a period of time. Thereafter, the foam filler is removed, whereupon the blocks formed in situ function to prevent the soil or surface from being eroded. The spaces between the blocks 11 as well as the holes formed in the blocks 11 allow vegetation to grow therethrough to thereby further anchor the blocks 11 to the surface. The number of openings in each block, and thus the open area of a matrix can be varied by filling one or more, or none of the openings in each composite mold 10 with cement. The open area of a block matrix need not be uniform, as the blocks on the edge of the matrix may be formed to have more open area than the blocks 11 internal to the matrix. The various degrees of freedom of movement of the blocks 11 allow such blocks to be installed over rough or undulating terrain and still remain interlocked without the concern of being lifted and removed from an interlocked condition. If different types of concrete, color, strength, etc., are needed in the same installation, this can be easily accomplished by simply pouring the desired type of concrete at the desired mold locations of the matrix. No special shipping, stacking or sorting of different types of blocks is necessary, and the installation of different types of blocks is easily facilitated.

Figure 10:
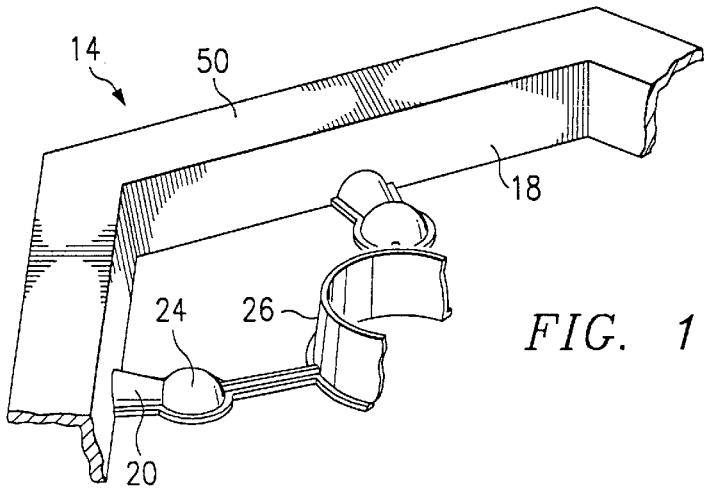
FIG. 10 is a partial view of a mold bottom half showing a peripheral flange for preventing concrete from flowing between adjacent interlocked blocks.

As an alternative to the usage of a foam filler in the spaces between the composite molds 10, the edge band 18 can be constructed with a peripheral flange 50, such as shown in FIG. 10. The peripheral flange 50 is formed integral with the vertical edge band 18, but extends laterally outwardly somewhat more than half the distance of the space between the blocks 11. With the use of the flange 50, the flange of one block and the flange of a neighboring block can overlap to prevent concrete from filling the spaces between the blocks. The flanges 50 do not interfere with the articulation of the blocks. In order to maintain the mold top part 12 and the mold bottom part 14 identical, a flange may also be formed on the bottom mold part 14 which rests against the surface of the ground, thereby preventing the composite mold 10 from being pushed into the surface of the ground during installation.

Figure 11:
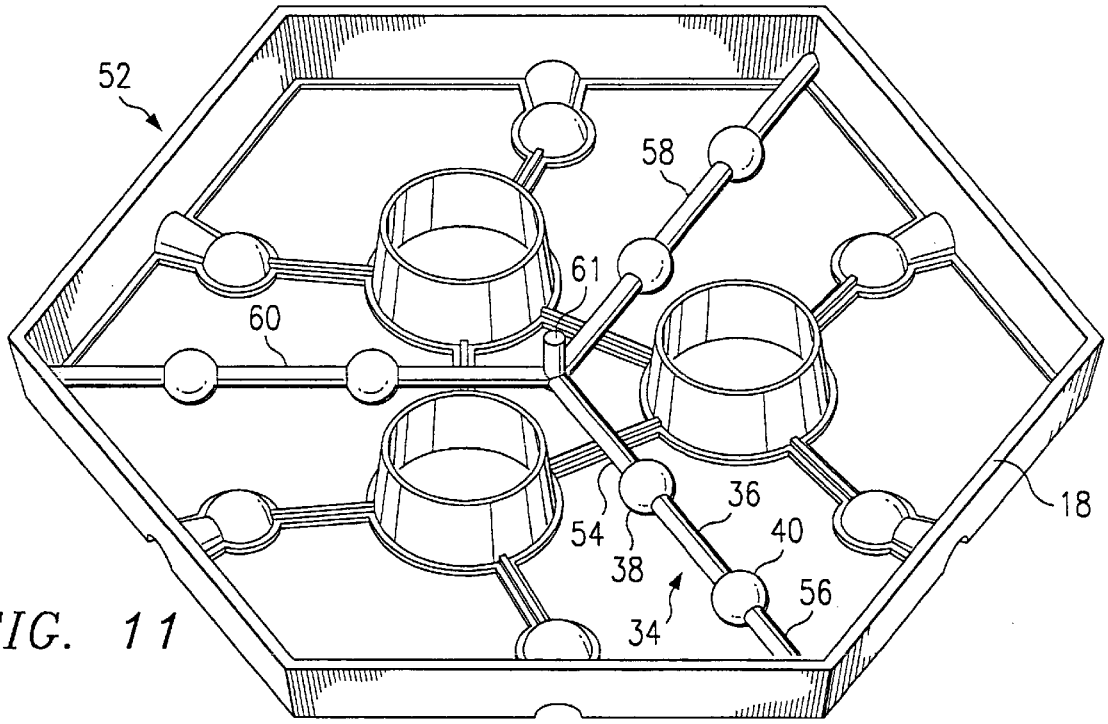
FIG. 11 is an isometric view of the mold top half just subsequent to the injection molding process.

With reference now to FIG. 11, there is illustrated a mold top half 52 subsequent to the formation thereof, it being realized that the mold bottom half is identically constructed. The mold top half 52 is substantially identical to that shown in FIG. 3, but with three connectors 34, 58 and 60 molded integral therewith. A first connector 34 is formed in the same injection molding process as the remainder of the mold top half 52. The connector 34 includes a connecting web 54 extending from an inner enlarged end 38, and another connecting web 56 extending from the opposing enlarged end 40. The connecting web 56 connects the enlarged end 40 to the inside portion of the edge band 18. The other connecting web 54 extends toward the middle of the mold top half 52, and connects to the respective webs associated with the other two connectors 58 and 60. An upright stub 61 is the result of an injection mold inlet for allowing the plastic material to be channeled into the injection mold (not shown) for forming the mold top half 52. The various connecting webs 54 and 56 are formed with a line of weakness or a thinned part to facilitate removal thereof from the edge band 18. Once the connectors 34, 58 and 60 are removed, the mold half 52 appears like that shown in FIG. 3. Because each full or composite mold 10 can accommodate six connectors, each mold half is made with three connectors removable therefrom.

The mold 10 utilized for the blocks 11 is fabricated in the following manner, according to the preferred form of the invention. The mold halves are fabricated by an injection molding techniques, utilizing recycled polypropylene injected into a metal mold machined or otherwise formed internally in the shape of the mold half 12. The use of a recycled material facilitates the cost effectiveness of the mold and block. The sidewall thickness of the edge band 18 is about 0.10 inch, as are the sidewall thicknesses of the other structures of the mold half 12. Also as noted above, the various vertical structures of the mold half 12 are formed with a taper of about 5° to facilitate removal of the mold half from the injection molding device. The mold halves 12 and 14 are fabricated so that when placed together, they result in a block 10 about 4.5 inches thick, with three holes, each hole opening having a diameter of about 4.0 inches. The block diameter between parallel edges of the mold is about 18.0 inches, and the diameter between opposing comers of the hexagonal-shaped block 11 is about 21 inches. When the mold halves 12 and 14 are filled with a mixture of two inch-three inch slump type 4000 psi concrete, the block 11 weighs about ninety pounds. The weight of the block 11 may be different if fabricated with asphalt or other heavy materials.

Each connector 34 is fabricated with opposing spherical enlarged ends 38 and 40 having a diameter of about one inch. The midsection 36 of each connector 34 is about ⅜ inch in diameter, and the center-to-center dimension between the spherical enlarged ends 38 and 40 is about 4⅞ inches. The connector 34 is constructed of a high impact type of polypropylene material with a tear strength of 5,000 psi or greater. With such type of construction, and when interlocked within the socket structures of neighboring blocks, the space between the blocks is about 1⅛ inch. The socket top half and socket bottom half are constructed such that when placed together, with an enlarged end 38 of a connector 34 disposed therein, the clearance therebetween is about 0.001 inch. The contact between the closed socket cavity and the enlarged end of the connector 34 is a plastic-plastic interface which is self lubricating and allows easy articulation of one block 11 with respect to another.

Figure 12:
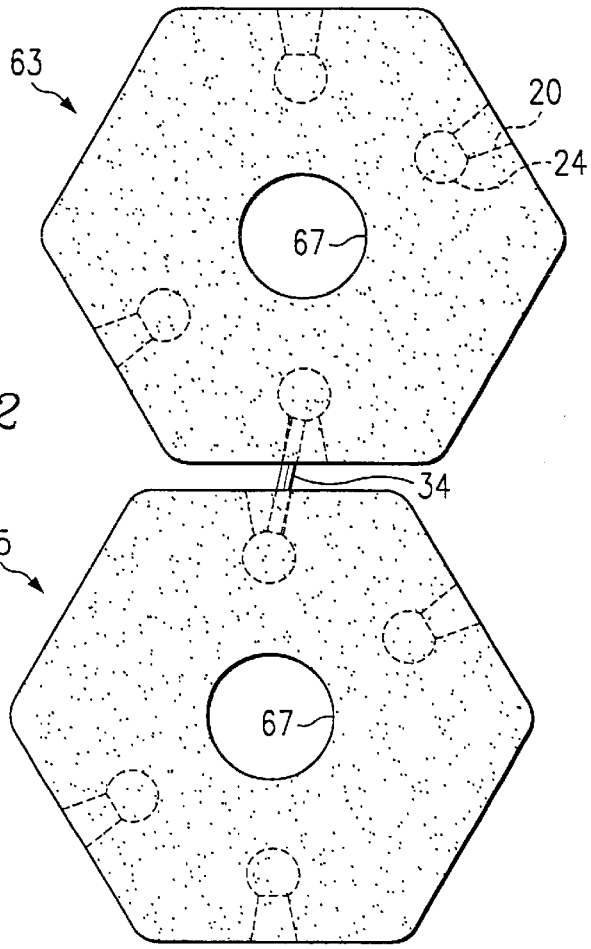
FIG. 12 is a top view of two blocks constructed according to another embodiment of the invention, showing the nature and degree of articulation between adjacent blocks that are laterally displaced from each other.
Figure 13:
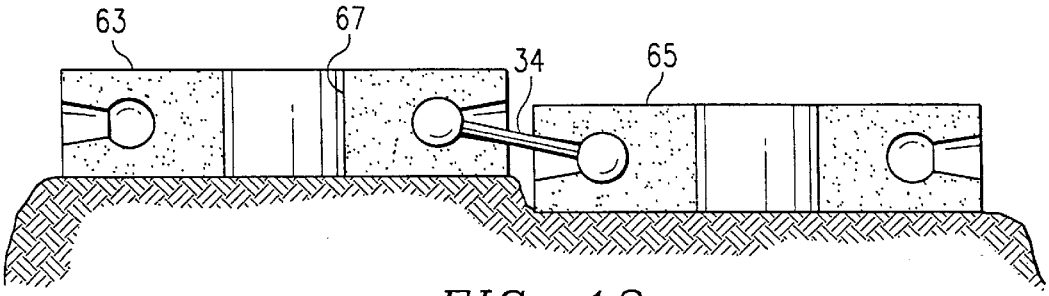
FIG. 13 is a sectional view of two interconnected blocks, showing the degree or articulation between two level blocks laid at different elevations.

The plastic ball and socket arrangement utilized to interconnect two blocks together provides two independent mechanisms for articulation between pairs of blocks. This is illustrated in FIGS. 12 and 13. As shown in FIG. 12, one block 64 can be displaced laterally with respect to an adjacent block 66, but remain interlocked together. This double-type articulation is also realized when two blocks are laid on the ground at two level areas that are at different elevations. Each block is itself level and interconnected together with a connector 34 that is oriented at an angle with respect to a vertical reference (FIG. 13). In this situation, the connector 34 with its ball and socket connection to each block maintains an interlocking connection to the block located at the higher elevation and the block at the lower elevation. The prior art interlocking blocks were not capable of such type of interlock, while maintaining the adjacent interlocked blocks level. As noted above, the channel structure 20 connecting the socket structure 24 to the edge band 18 is conical in shape, allowing a maximum angular movement of about 25°.

As can be appreciated, if the open space in the matrix of interconnected blocks is desired to be larger, either the holes in each block can be made of a larger diameter, more holes can be utilized within each block, or the midsection 36 of the connector 34 can be made longer to separate the blocks a greater distance from each other. If less open space is desired, the holes in the blocks can be filled with concrete, and/or the connector 34 and midsections 36 can be made shorter.

In the event that one or more blocks of a matrix require replacement, the broken or damaged block can be broken into pieces with a sledge hammer and the parts removed. The mold parts, except for the connectors 34, and the broken cement pieces can be discarded. A new mold bottom half 14 can be laid on the ground in the vacant space, and the connector ends of the neighboring blocks laid in the respective socket cavities. Then, a new mold top half 12 can be snap locked onto the mold bottom half 14, and cement poured in the composite mold 10. Importantly, the breaking of the damaged block does not destroy the connectors, as such members are very sturdy and will withstand an impact or a certain degree of flexing.

Figure 14:
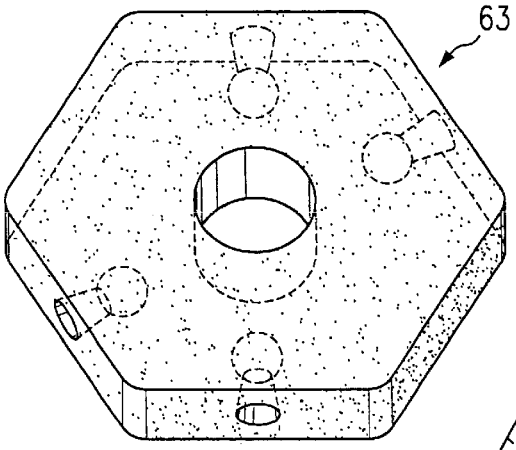
FIG. 14 is an isometric view of the block constructed according to the embodiment of FIG. 12.
Figure 15:
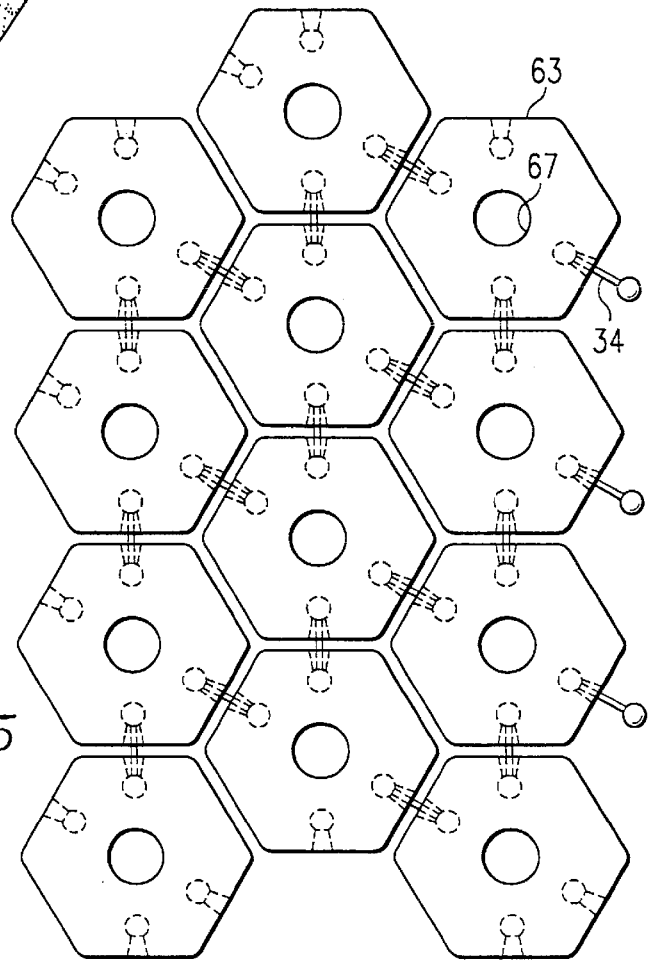
FIG. 15 illustrates a portion of a matrix of the blocks shown in FIG. 14.

FIG. 15 is a portion of a matrix with blocks constructed according to the embodiment of FIG. 14. With this construction, each block is hexagonal in shape but each block 63 includes only four interlocking arrangements for accommodating four corresponding connectors 34. Stated another way, two adjacent sides have formed therein the cavity and conical-shaped structure, two opposite sides that are adjacent have the cavity and conical-shaped structures, and two opposite sides do not have such structures. It should be understood that the same number of connector interconnections can be used with the block 11 of FIG. 2 by not using the connectors 34 in two opposite sides of each block 11. Those skilled in the art may appreciate that other numbers and arrangements of cavity and connectors can be employed to satisfy various constraints.

The block 63 has one opening 67 which, together with the interblock spaces, provide a given percentage of open space for the growth of vegetation, or to obtain a desired hydraulic action.

Figure 16:
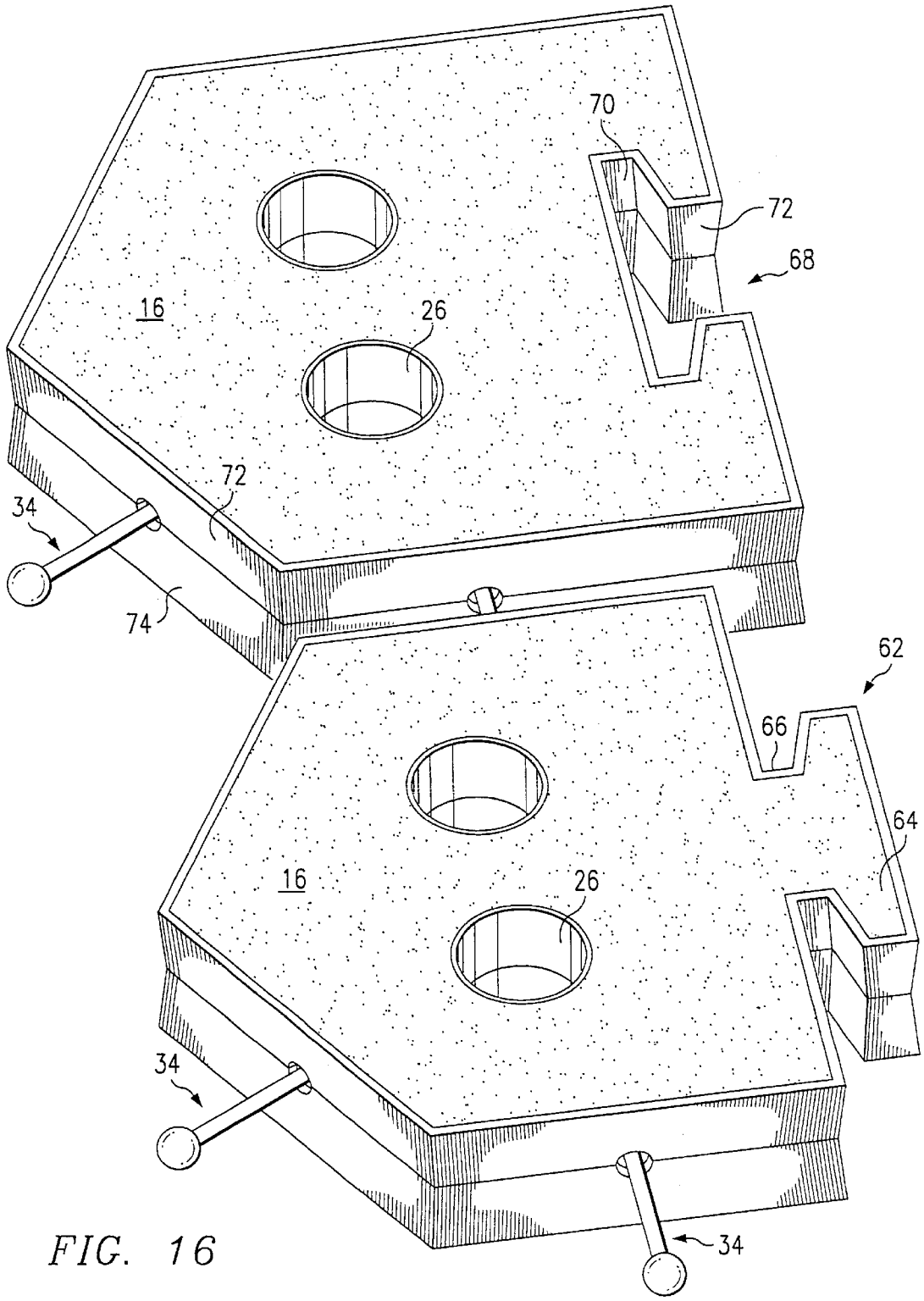
FIG. 16 is an isometric view of another embodiment of a pair of blocks formed in a mold providing two different types of interlocking mechanisms.
Figure 17:
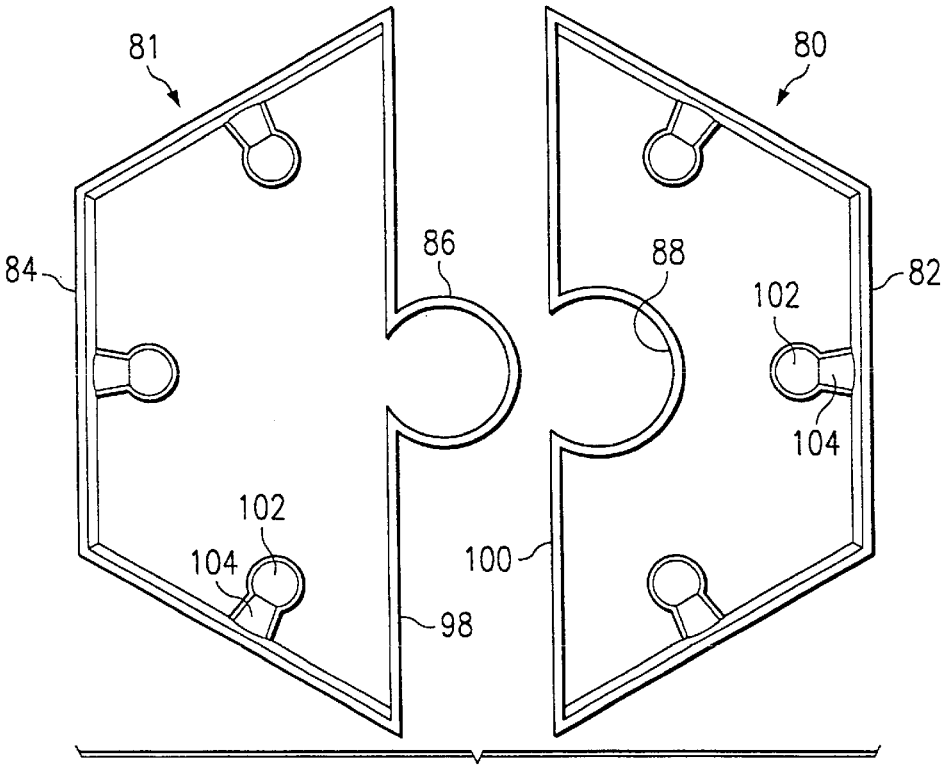
FIG. 17 is a top view of two mold halves providing a male/female interlocking feature, with the blocks shown removed from each other.
Figure 18:
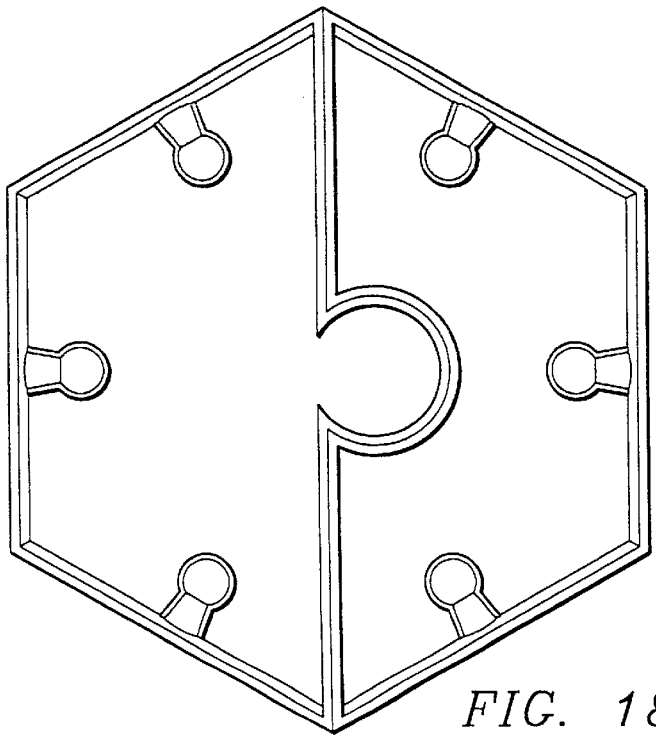
FIG. 18 is a top view of FIG. 17, showing the neighboring blocks interlocked via the male and female members.
Figure 19:
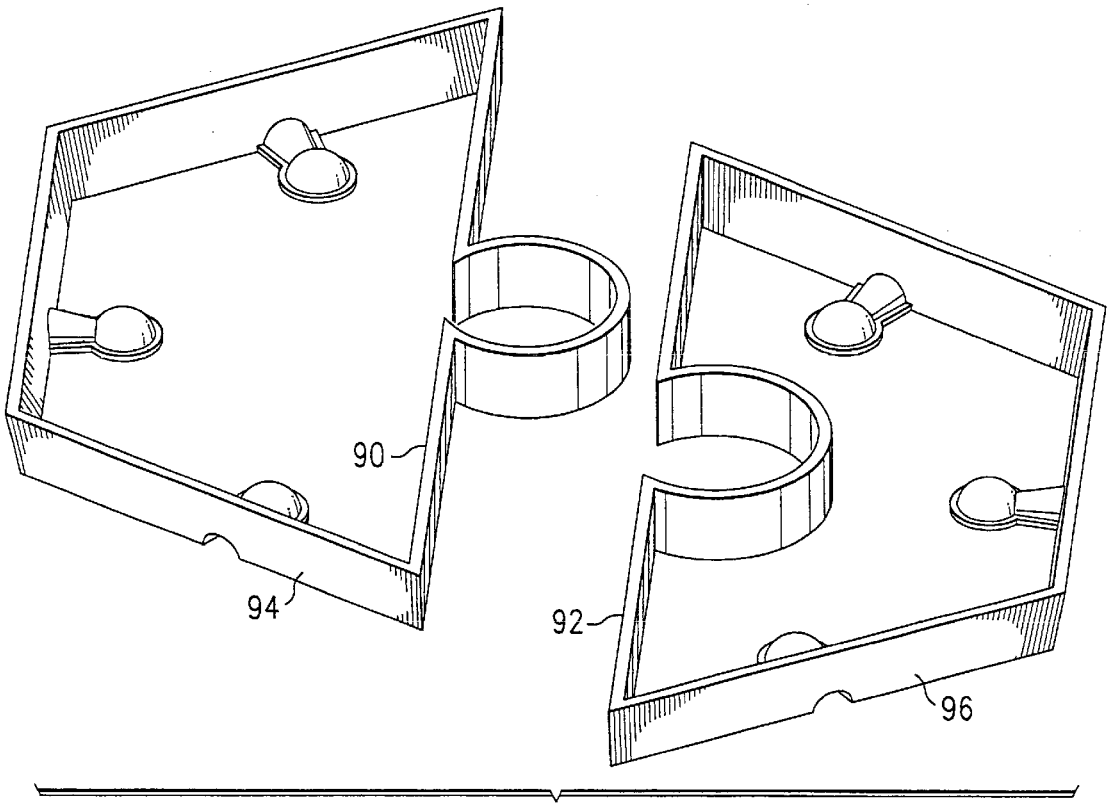
FIG. 19 is an isometric view of the top mold halves of the embodiment shown in FIG. 17.

The principles and concepts of the invention can also be extended to accommodate the interlocking structures of prior art types of blocks. In other words, rather than connecting each edge of a block with a connector 34, an arm and corresponding socket type of structure such as shown in FIG. 16 can be utilized on a portion of the block. This type of male and female interlocking arrangement can be utilized for connecting one section of a matrix to another section. Each block is constructed with a mold top half 72 and a mold bottom half 74 that can be snap-locked together. Other than the shape of the top and bottom edge bands, the mold halves 72 and 74 would be formed much like that shown in FIGS. 1–4. Two top-to-bottom openings 26 are formed using the cylindrical-shaped members described above.

The blocks on the periphery of a matrix section can be constructed with mold top halves and mold bottom halves so as to form an ear 62 having an enlarged end 64 connected to the body of the block with a narrowed neck portion 66. In a neighbor block interlocked thereto by a connector 34, a corresponding socket 68 is formed, with an enlarged socket opening 70 coupled to the edge of the block by a narrowed inlet portion 72. A neighboring matrix section 62 would have blocks similarly constructed so that the arm of the neighboring block would fit into the socket 68 of the block of the other matrix section. In like manner, the arm 62 of the block of the one matrix section would fit into the socket of the block in neighboring matrix. Although this interlocking type of structure allows unconstrained vertical movement between the peripheral blocks of each matrix section, such type of structure facilitates the underwater installation and interlockability of a series of matrix sections together. Stated another way, for underwater operation, each matrix section of blocks can be fabricated near the installation site as a matrix section of blocks, with the peripheral blocks of the matrix section constructed as shown in FIG. 16. The other internal blocks of the matrix section would be formed and interconnected with captured connections in the manner noted in FIGS. 1–4. Then, each matrix section of blocks would be lifted one at a time by a crane using the appropriate spreader bars, or the like, and lower the matrix section into the underwater location. The edge of each installed matrix section can be interlocked using the open interlocking structures shown in FIG. 16. The underwater interconnection of one matrix section with another can be accomplished much like the closing of a zipper.

The utilization of an integral mold can also be employed to fabricate interlocking blocks without any captured connectors 34. In other words, open-type interlocking structures can be used on two or more sides of the block. The edge band of the mold of such type of block would be formed with plural ears 62 and open sockets 68 formed around the periphery of the block. Other than having a mold integral therewith, the blocks would appear very similar to the shape of prior art interlocking blocks. However, with the use, if any, of an internal web structure and an edge band, the blocks would be stronger than the prior art blocks, and can economically be made at the installation site. Indeed, an internal heavy duty web can be connected to the edge band in the neck 66 of the ear 62 to provide reinforcement thereto. Even if the cement portion of the neck 66 cracked, the internal reinforcing web would maintain the parts intact and thus the blocks would not have to be replaced or discarded. Similar internal support webs could be formed in the open socket portions 68 of the block.

Figure 20:
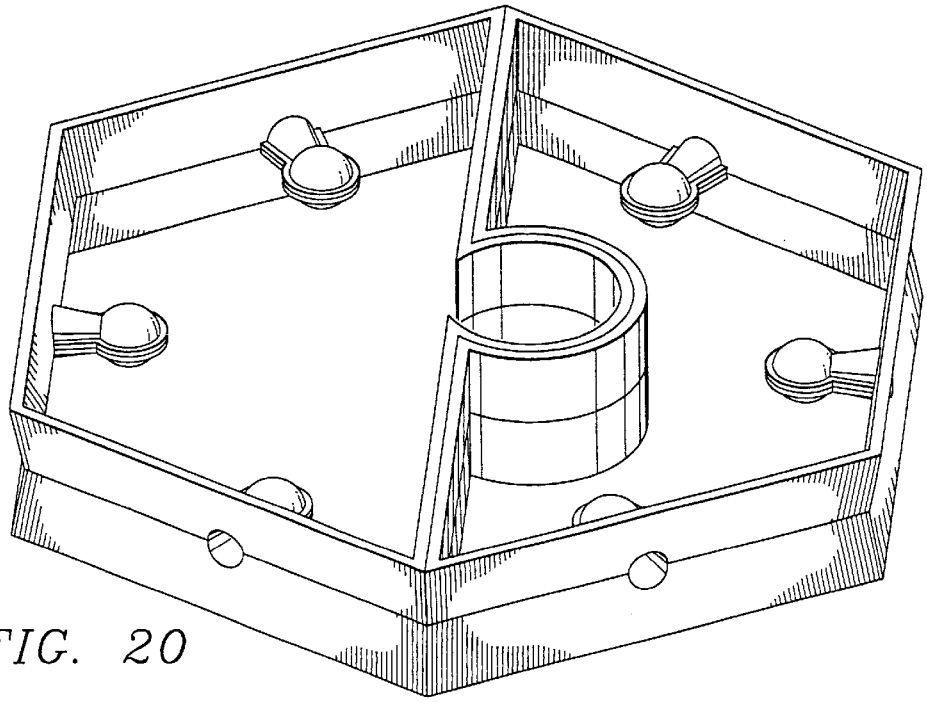
FIG. 20 is an isometric view of the mold top and bottom halves of the neighboring blocks interlocked via the male and female members.

FIGS. 17–20 illustrate yet another embodiment of the invention. Much like the embodiment shown in FIG. 16, the block of FIGS. 17–20 incorporates both captured connectors and open-type interlocking arms and sockets. By the term "open-type", as contrast to "captured", it is meant that the blocks can be interlocked to prevent removal or separation from each other in various directions, but when moved with respect to each other in yet other directions, the blocks can be separated. In the use of the block mold of FIG. 17, one block mold 82 can be removed from the other 84 by lifting the one block mold 82 vertically to disengage the arm 86 from the open socket 88. Each block mold 82 and 84 is constructed with a respective mold top half 90 and 92, and a mold bottom half 94 and 96, snap locked together. Each block is effectively one half of a hexagonal-shaped block shown in FIG. 2, but with the edge band formed to provide either an arm 86 extending from an elongate planar side 98, or an open socket 88 recessed within the elongate edge 100. Those skilled in the art may desire to provide both an arm 86 and an open socket 88 adjacent each other within the same block for interlocking with corresponding elements of a neighboring block. It is noted that the mold for forming male-type block 81 and the female-type block 80 utilizes the semi-spherical sockets 102 and conical-shaped channel 104 structures associated with each of the shorter sides of the block. Again, there is a top mold half 90 and 92 and a bottom mold half 94 and 96 which, when snap-locked together as shown in FIG. 20, provide a form into which a heavy material, such as cement, can be poured.

While the embodiment shown in FIGS. 17–20 does not utilize internal webs to provide support and/or interconnections between the various members, those skilled in the art may incorporate the same into the injection mold. Installation and formation of a block utilizing the two-part mold illustrated in FIGS. 17–20 is accomplished in substantially the same manner noted above. Such type of block utilizing both captured and open-type interlocking members is highly advantageous where it is desired to provide a generally nonseparable matrix of block, but where the matrix can be engaged and/or separated along a line of the neighboring blocks united by the open-type interlocking members. As noted above, the under water installation of such type of block can be facilitated.

The mold of the various embodiments can also be constructed in some instances as a one part mold. Also, the mold can include other structures, other than shown or described herein. For example, the mold may be formed with a top or bottom cover that extends substantially between the edge band. The cover can provide containment of the cement and/or provide desired hydraulic characteristics.

The edge band mold can also be utilized with "interfitting" blocks which prevent movement between blocks in only one lateral direction. Such type of blocks can be economically made on site, and made with or without holes therethrough. The various features of the invention are not to be limited to any type or family of blocks, but can be employed in any type of block, irrespective of the ultimate use or function of the block.

From the foregoing, disclosed is a method of making a block in an economical manner, where the block is fabricated with an integral mold and with vertical openings formed in the body of the block. The block according to one embodiment requires no cables to either maintain an interlocked relationship, or for installation as a matrix section. The captured ball and socket connector arrangement between each one-piece block facilitates articulation and interlockability, with multiple degrees of flexibility.

While the preferred and other embodiments of the invention have been disclosed with reference to specific forms of molds and blocks, and methods of installation thereof, it is to be understood that the many changes in detail may be made as a matter of engineering choices, without departing from the spirit and scope of the invention, as defined by the appended claims.

What is claimed is:

1. A construction block, comprising;

a heavy material;

a mold constructed of a moldable material, said mold including a circumferential edge band formed of the moldable material throughout the thickness of said edge band, said edge band having an inside surface defining a circumferential side edge of said heavy material, and said edge band having an outer surface defining the shape of said block;

said mold including one or more opening members attached to said edge band for defining respective openings in said block extending from a top surface of said block to a bottom surface of said block, each said opening member disposed inside said circumferential edge band, and no portion of said mold extends from said circumferential edge band to the opening members which is visible when said mold is filled with said heavy material;

a respective web of moldable material connecting each said opening member to the inside surface of said circumferential edge band, said webs located so as to be fully embedded in said heavy material;

said heavy material filling said mold, inside said circumferential band except for an inner part of each opening member; and said mold formed so that when said heavy material fills said mold, said mold does not cover the openings at either opposing end thereof.

2. The construction block of claim 1, wherein said mold is integral with said heavy material to prevent separation thereof.

3. The construction block of claim 1, further including means for interlocking a plurality of said blocks together to prevent separation thereof when pulled apart in at least one direction.

4. The construction block of claim 1, wherein said mold is constructed as a two-part mold having a mold top half and a mold bottom half.

5. The construction block of claim 4, wherein said mold top half and said mold bottom half are constructed in a substantially identical manner.

6. The construction block of claim 5, wherein said mold top half and said mold bottom half are formed so as to be locked together prior to insertion therein of said heavy material.

7. The Construction block of claim 6, wherein said top edge band portion and said bottom edge band portion have engaging members for snap locking the top and bottom edge band portions together.

8. The construction block of claim 4, wherein each said opening member includes a top cylinder portion and a bottom cylinder portion which, when placed one on top of the other, define said opening member.

9. The construction block of claim 4, further including a ground cover fabric for placement between said mold top and bottom halves to provide an interlocking structure between adjacent said blocks.

10. The construction block of claim 4, further including a socket half formed in said mold top half and a socket half formed in said mold bottom half, such that when both mold halves are placed together a full substantially enclosed socket is formed, said socket, having an opening therein directed to a sidewall of the respective mold half.

11. The construction block of claim 10, further including in combination a connector having an elongate midsection and enlarged ends, one said enlarged end for fitting within said socket, and said connector midsection extending through said socket opening.

12. The construction block of claim 11, further including an opening formed in one or both edge bands of said mold top and bottom halves, and a sleeve formed of said moldable material extending between said socket opening and the edge band opening of said mold top half and said mold bottom half.

13. The construction block of claim 12, wherein said sleeve is conical-shaped.

14. The construction block of claim 4, wherein at least one opening member is supported by a web connected to said circumferential edge band of the mold top half, and at least one opening member is supported by a web connected to said circumferential edge band of the mold bottom half, so that when said mold top half is placed on said mold bottom half, said opening members are aligned along a respective common vertical axis.

15. The construction block of claim 14, wherein said webs are embedded in said heavy material, whereby said mold top and bottom halves remain integral with said heavy material.

16. The construction block of claim 4, wherein each said mold top half and said mold bottom half include a respective said circumferential edge band that is formed at an angle with respect to a vertical reference, and said mold top half and said mold bottom half are formed so that when placed together, the circumferential edge bands formed by both mold halves have a smaller circumference around a middle edge section of said block as compared to a circumference measured at a top or bottom surface of said block.

17. The construction block of claim 1, wherein said circumferential edge band is hexagonal shaped.

18. The construction block of claim 17, wherein each side of said hexagonal-shaped circumferential edge band includes an opening, each said opening forming an opening to a respective socket formed of said moldable material.

19. The construction block of claim 18, further including a respective connector engaged in each said socket, each said connector having an enlarged end captured in a respective said socket.

20. The construction block of claim 18, wherein each said socket is substantially surrounded by said concrete material.

21. The constriction block of claim 1, wherein said mold includes an edge band made of plastic and having a thickness of between about 0.08–0.2 inches.

22. The construction block of claim 1, wherein said mold has an open top that extends between the circumferential edge band.

23. The construction block of claim 1, wherein one said opening comprises a cavity formed in an edge portion of said block, said cavity adapted for engagement with an arm of another similar block to prevent substantial movement between the blocks in at least one lateral direction.

24. The construction block of claim 1, further including interlocking means structured so that one said block can be interlocked with another said block in such a manner that the interlocked blocks cannot be separated without fracture of said block when attempted to be moved apart laterally.

25. The construction block of claim 24, wherein said interlocking means is formed so that adjacent interlocked blocks cannot be separated without fracture of said block when one block is moved vertically with respect to an adjacent interlocked block.

26. The construction block of claim 24, wherein said block is formed with an elongate arm extending outwardly from the block, and wherein said mold is formed with a shape defining a socket extending inwardly in said block, said socket being shaped to receive therein an enlarged end of a connector of another adjacent said block.

27. The construction block of claim 26, wherein said mold is formed so that said enlarged end of said arm is captured in said socket and cannot be removed therefrom without fracture of said block when construction of said block is completed.

28. The construction block of claim 26, wherein said mold is formed with a shape such that said arm and corresponding enlarged end are integral with said block and not removable with respect to said block without fracture of said block.

29. The construction block of claim 26, wherein said mold is formed with a shape such that said arm and corresponding enlarged end are movable with respect to said block while interlocked thereto.

30. The constriction block of claim 1, further including a respective interconnect web interconnecting neighboring cylinder members together, said interconnecting webs being embedded in said concrete material.

* * * * *